US005152038A

United States Patent [19]

Schoch

[11] Patent Number: 5,152,038

[45] Date of Patent: Oct. 6, 1992

[54] ROTARY CLOSURE FOR A SPORTS SHOE

[75] Inventor: Robert Schoch, Hilzingen, Fed. Rep. of Germany

[73] Assignee: Weinmann GmbH & Co. KG, Fed. Rep. of Germany

[21] Appl. No.: 501,489

[22] Filed: Mar. 29, 1990

[30] Foreign Application Priority Data

Apr. 20, 1989 [DE] Fed. Rep. of Germany ..... 3913018

[51] Int. Cl.[5] ..... A43C 11/00

[52] U.S. Cl. ..... 24/68 SK; 24/71.2

[58] Field of Search ..... 24/68 R, 68 SK, 68 CD, 24/71.2, 68 CT; 36/50

[56] References Cited

U.S. PATENT DOCUMENTS 803,489 10/1905 Johnson ..... 24/68 SK
4,433,456 2/1984 Baggio ..... 24/68 SK
4,633,599 1/1987 Morell et al. ..... 24/68 SK X
4,748,726 6/1988 Schoch ..... 24/68 SK
4,787,124 11/1988 Pozzobon et al. ..... 24/68 SK
4,841,649 6/1989 Baggio et al. ..... 24/68 SK X
4,884,760 12/1989 Baggio et al. ..... 24/68 SK X

*Primary Examiner*—James R. Brittain
*Attorney, Agent, or Firm*—Learman & McCulloch

[57] ABSTRACT

In this rotary closure according to the invention for a sports shoe a traction cable arrangement for drawing together the shoe closure flaps can be wound onto and unwound from a rotatable cable pulley. The traction cable arrangement consists of one single traction cable, and coaxially with the cable pulley a stop element is provided and rotatably mounted in such a way that the cable pulley can carry out a maximum of up to approximately two revolutions in one direction of rotation. In this way a particularly compact rotary closure is produced with reliable security against over-rotation of the cable pulley.

15 Claims, 5 Drawing Sheets

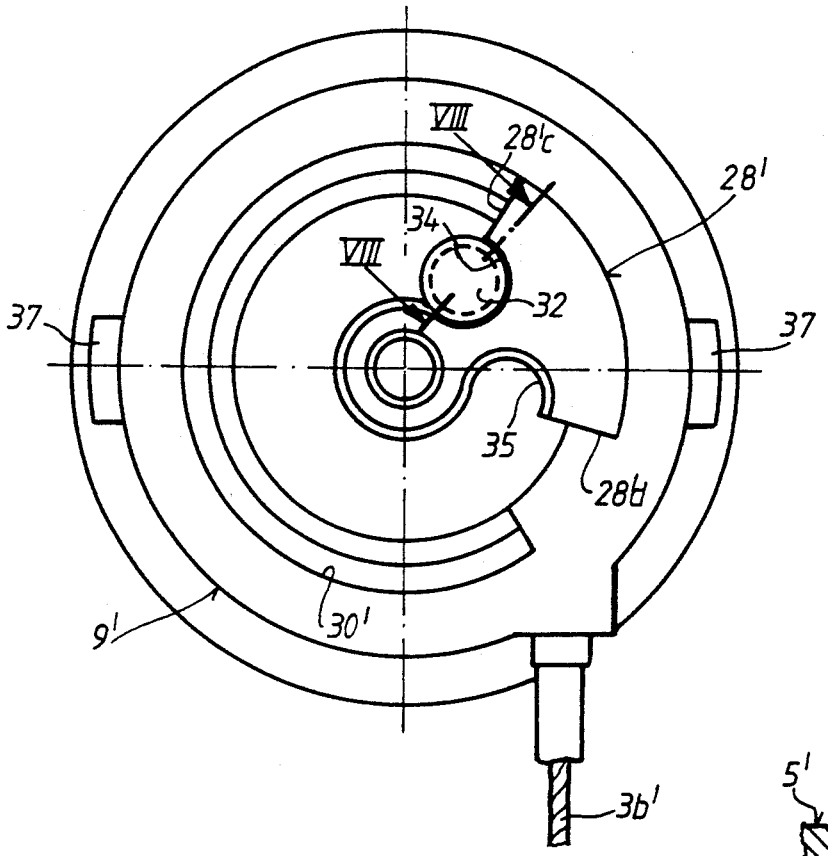
FIG. 7
FIG. 8
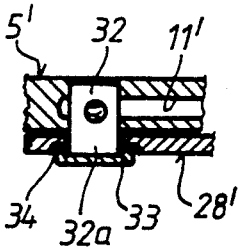
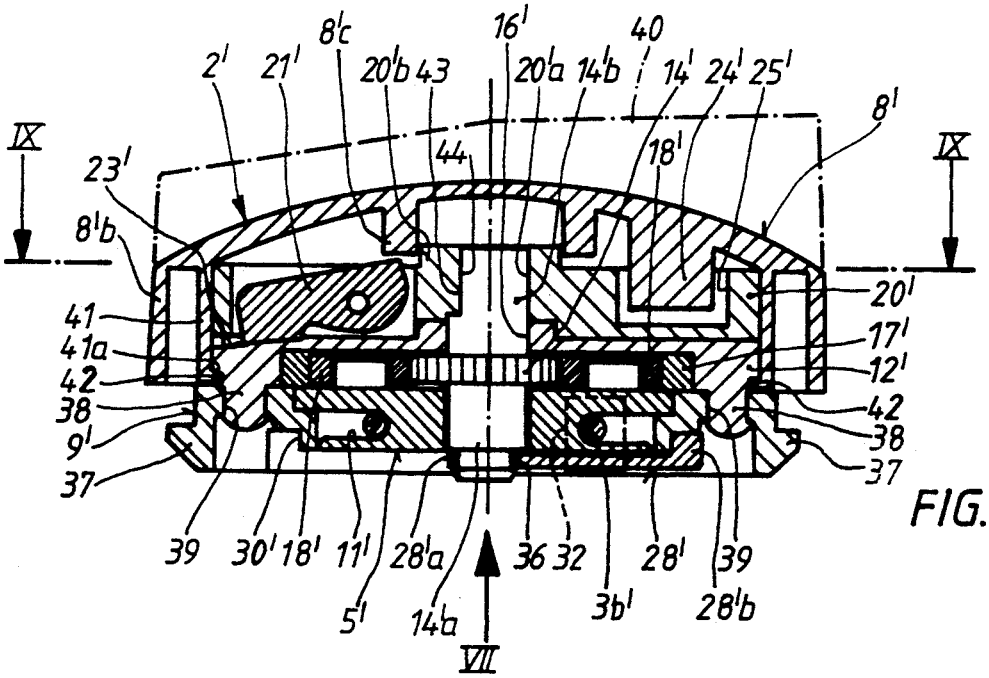
FIG. 6

ROTARY CLOSURE FOR A SPORTS SHOE

TECHNICAL FIELD

The invention relates to a rotary closure for a sports shoe such as a ski boot.

BACKGROUND OF THE INVENTION

A rotary closure of the type in which the invention is employed is disclosed in European application EP-A-255 869. In this known rotary closure the closure flaps of a shoe can be drawn together or loosened by a rotary movement of the actuating mechanism in one or the other direction so that the effective length of two traction cable tensioning elements is altered in opposite ways. In this case, in order to be able to adapt the shoe accurately to the user's foot an accurate adjustment of the rotary closure is provided by including a ratchet mechanism in the region between a rotating knob and a cable pulley for the two traction cable tensioning elements. The ratchet mechanism contains an intermediate element which is rotatable with the rotating knob while maintaining free play, a ratchet borne on the intermediate element and a toothed ring machined in a housing cover. The cable pulley is rotated by the rotating knob with the interposition of a Maltese cross transmission, a gear drive or a planetary gear.

SUMMARY OF THE INVENTION

An object of the invention is to provide a rotary closure for a sports shoe in which the space required and the production costs are minimized.

Another object of the invention is to provide a rotary closure for a sports shoe that can be rotated in one direction only to secure the shoe and can be rotated in the opposite direction only to release or loosen the shoe.

In the rotary closure according to the invention only a single traction cable is used in the traction cable arrangement thereby enabling production costs to be lowered and its dimensions—particularly with regard to a smaller diameter—to be reduced.

In this construction according to the invention, in order for the closure flaps to be drawn sufficiently far together by the single traction cable so as to be able to ensure constantly reliable adaptation of the shoe to the user's foot, a sufficiently long cable path (that is to say a corresponding lengthening, optionally almost a doubling of the cable path in comparison with the known construction described above) is advantageous. In the rotary closure according to the invention this can be achieved by approximately two rotations of the cable pulley, the stop being effective by means of the stop element after the second rotation. A stop is necessary in order to prevent damage to the traction cable resulting from over-rotation.

DESCRIPTION OF THE DRAWINGS

FIG. 6 is a cross-sectional view, similar to that of FIG. 2, of a second embodiment of the rotary closure;

FIG. 7 is an underneath view in the direction of the arrow VII in FIG. 6, of the embodiment shown in FIG. 6;

FIG. 8 is a sectional view of a detail taken along line VIII—VIII in FIG. 7;

DESCRIPTION OF THE PREFERRED EMBODIMENTS

Figure 1:
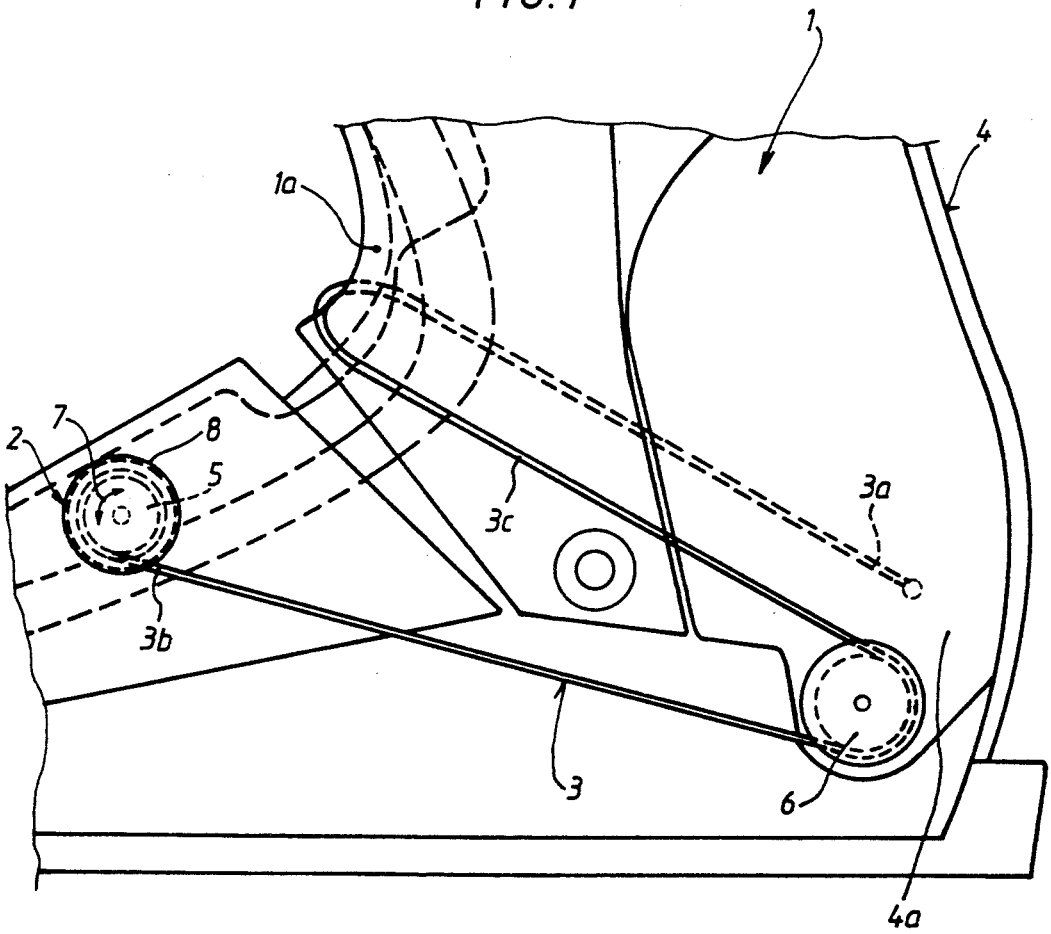
FIG. 1 is a partial outer view of a sports shoe represented as a ski boot having an embodiment of the rotary closure according to the invention.

One of a series of possible ways in which the rotary closure 2 can be applied to a sports shoe is shown in FIG. 1 on a ski boot 1 which is only partially illustrated. In the chosen example it may be assumed that this rotary closure 2 can be arranged with its housing (which is not shown in detail in FIG. 1) on the outer shell, in fact in the instep region thereof, of the ski boot and is secured to the outer shell with the aid of means which are known per se and are therefore not shown in greater detail in FIG. 1.

This rotary closure 2 contains by way of a traction cable mechanism one single traction cable 3 of which one outer end 3*a* in the present case is fixed on one side of the top of the boot, in the lower heel region 4*a* thereof, while the other end 3*b* of the traction cable is fixed on a cable pulley 5 which is mounted in a manner which will be explained below so as to be rotatable in the housing of the rotary closure 2 in order to wind up and unwind the traction cable 3. The section 3*c* lying between the two ends 3*a* and 3*b* of the traction cable is passed over the two closure flaps which are to be drawn together (one is indicated at 1*a*) of the ski boot 1 (for instance in the upper instep region) and then passed over a suitable guide pulley 6 on the side of the top of the boot which lies opposite the free outer end 3*a* to the actual rotary closure 2 with the cable pulley 5. In order to be able to carry out this winding on and off of the traction cable, the rotary closure 2 has an actuating mechanism for rotating the cable pulley 5 in one or the other direction (cf. double headed arrow 7), this actuating mechanism being formed in the present case by a cap-shaped rotary knob 8 which will be explained in greater detail below.

Figure 3:
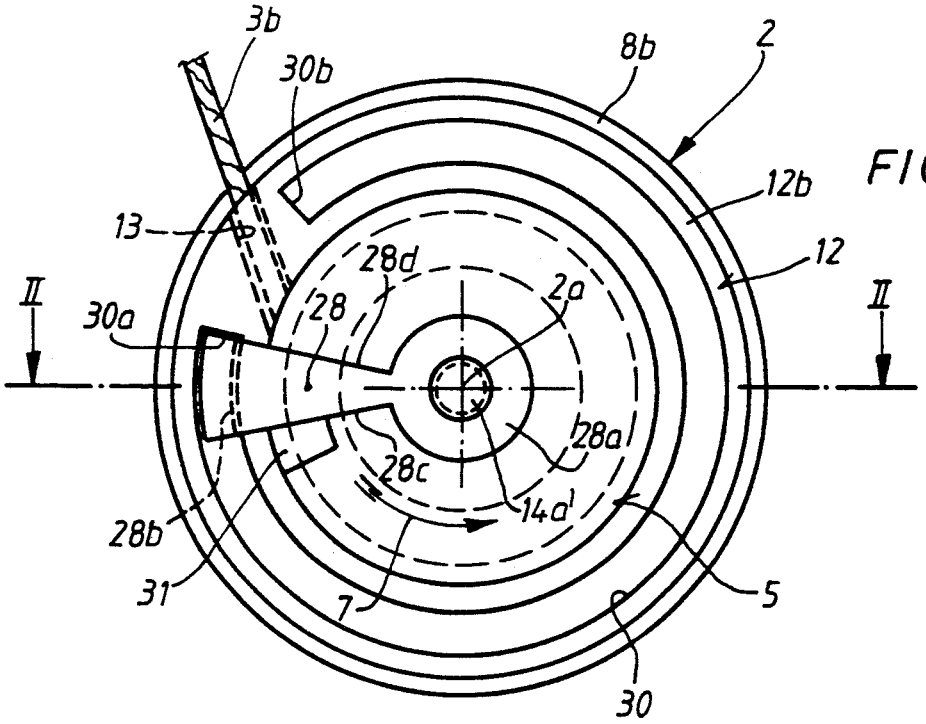
FIG. 3 is an underneath view of the rotary closure taken along the line III—III in FIG. 2 illustrating the starting position of the cable pulley and the stop element before the traction cable is wound up.
Figure 2:
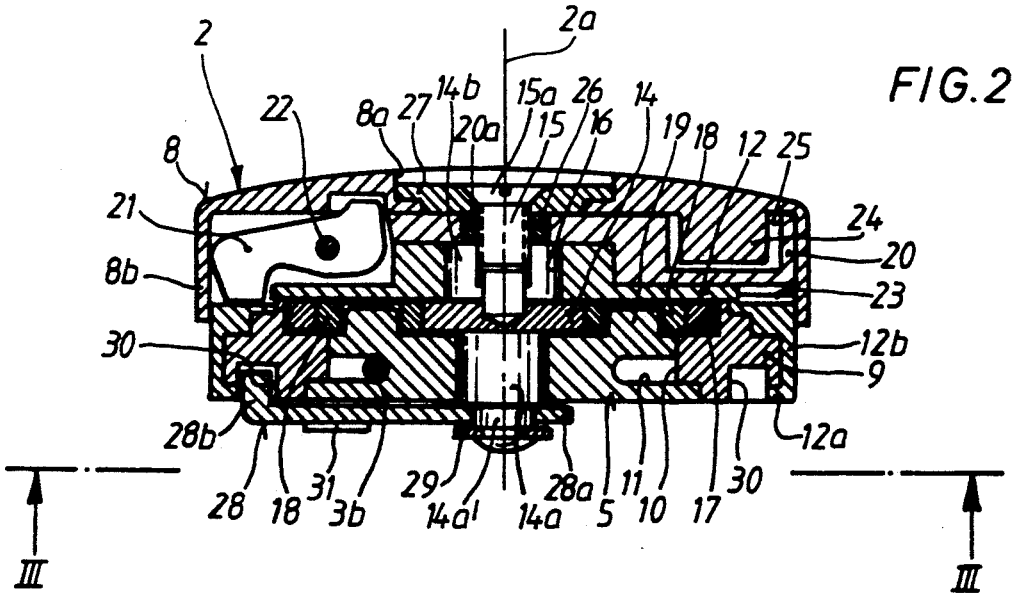
FIG. 2 is a cross-sectional view through the assembled rotary closure, approximately according to the section line II—II in FIG. 3.

A first embodiment of the actual rotary closure 2 is disclosed in FIGS. 2 and 3. According to these drawings this rotary closure 2 has a relatively flat approximately cylindrical housing 9 which has a central cavity 10 in which the traction cable pulley 5 is received so as to be freely rotatable and to fit—as regards its peripheral dimensions.

The traction cable pulley 5 has a cable groove 11 which runs around its periphery and in which the appertaining end 3*b* of the traction cable 3 is fixed. The cable groove 11 is sufficiently deep to accommodate two coils of cable in it.

The housing 9 is covered to a great extent at the top and practically completely on the periphery by a cover 12, and the housing 9 and the cover 12 can be connected to one another so as to be fixed, but also optionally releasable, by means of axially extending screws which are not shown in greater detail or—as indicated—by bending lower peripheral extensions 12*a* inwards under the lower peripheral edge of the housing 9.

As can be seen in FIG. 3, the end 3*b* of the traction cable which is connected to the cable pulley 5 is delivered approximately tangentially to the cable pulley 5 or to the cable groove 11 thereof through a guide channel 13 which passes appropriately through the peripheral wall 12*b* of the cover 12 and the housing 9.

As can be seen in FIG. 2, in the region between the housing 9, the cover 12 and the upper face of the cable pulley 5 there is a space in which a planetary gear set is provided in order to drive the cable pulley 5. A sun gear 14, which is arranged coaxially with the axis 2*a* of the rotary closure, immediately above the cable pulley 5, serves as the drive gear and is connected to the cap-shaped rotating knob 8 by a countersunk screw 15 so as to be fixed against rotation, belongs to this planetary set. This sun gear 14 has a journal-like axial extension 14*a* which extends downwards and forms a central journal pin for the cable pulley 5. In addition, this sun gear 14 has an extension in the form of a journal pin end 14*b* which extends axially upwards through a bearing bore 16 of the housing cover 12 and by means of which the sun gear 14 is rotatably mounted—so as to be freely rotatable—in the bearing bore 16 of the cover 12.

A ring gear 17 which has internal teeth and is mounted so as to be fixed against rotation on the inner periphery of the housing 9 in the region above the cable pulley 5, also belongs to the planetary gear set. Planet gears 18 which are preferably mounted so as to be freely rotatable on journal pins 19 which project upwards from the upper face of the cable pulley 5 are provided in the region between this ring gear 17 and the sun gear 14 and are in toothed engagement both with the sun gear 14 and with the stationary ring gear 17.

In a manner similar to that disclosed in connection with the known construction according to European Patent Application EP-A-255 869, an intermediate disc 20, in which a spring tensioned ratchet pawl 21 is mounted like a two-armed lever so as to be pivotable about a pivot pin 22, is arranged in the region between the housing cover 12 and the rotating knob 8. This spring tensioned ratchet pawl 21 belongs to a ratchet mechanism to which a toothed ring 23 machined in the outer peripheral region on the upper face of the housing cover 12 also belongs. The spring-tensioned ratchet pawl 21 and the toothed ring 23 can co-operate in such a way that during a rotary movement in the direction of winding up the traction cable 3 a fine adjustment and locking of the traction cable pulley 5 and thus of the traction cable 3 can be achieved, whilst in the other direction of rotation the toothed engagement between the ratchet pawl 21 and the toothed ring 23 is released and as a result the traction cable can be unwound from the cable pulley 5.

In order also to be able to carry out the necessary ratchet movement by appropriate means during this making or breaking of the toothed engagement between the ratchet 21 and the toothed ring 23, similar means can be provided to those of the aforementioned known construction, in which a downwardly directed projection 24 on the underside of the rotary knob 8 is accommodated in a recess 25 shaped like a ring sector in the upper face of the intermediate disc 20 to define a corresponding free play of the rotating knob 8 relative to the intermediate disc 20. It has already been mentioned that in this first embodiment of the rotary closure 2 the actuating arrangement for rotating the cable pulley 5 is constructed as a cap-shaped rotating knob 8 and is secured to the bearing pin end 14*b*, which extends axially upwards, of the sun gear 14 by means of a countersunk screw 15. However, the intermediate disc 20 is also arranged between the upper face of the housing cover 12 and this cover 8, i.e. the countersunk screw 15 also passes through a central bore 20*a* which is provided in this intermediate disc 20 and into which a type of sliding bearing ring can be inserted as a spacer piece. A flanged disc 27 in which the head 15*a* of the countersunk screw 15 is received is also inserted and received in a correspondingly offset central recess 8*a* in the upper face of the rotating knob 8. A suitable cover plate—not shown in detail here—can optionally be fitted in above this flanged disc 27 so as to be flush and easily releasably, in order to create a kind of protective cover. With one lateral peripheral wall 8*b* this cap-shaped rotating knob 8 also covers the region of the intermediate disc 20 as well as at least to some extent the housing 9 and its cover 12, since this peripheral wall 8*b* projects sufficiently far downwards, as can be seen in FIG. 2. In addition, the rotating knob can be provided, at least in the region of this peripheral wall 8*b* with millings or other suitable gripping elements so that it can be operated (turned) easily. This type of rotating knob 8 also contributes to a particularly flat and compact construction of the entire rotary closure 2.

However, it is of particular importance in this rotary closure 2 that a stop arm 28 is rotatably mounted coaxially with respect to the cable pulley 5 in or on the housing 9. As has been explained above, the axial extension 14*a* of the sun gear 14, which extends downwards like a pivot pin, forms a central journal pin for the cable pulley 5. This central journal pin 14*a* includes an axially extending 14*a*′ which is reduced in diameter and projects out of the cable pulley 5, so that the central (inner) section 28*a* of the stop element 28 is simultaneously mounted on this lower pin end so as to be freely rotatable. In order to secure this central section 28*a* on the pin end 14*a*′ an appropriate securing element, for example a spring clip ring 29, can be fixed on the outermost end of the pin end 14*a*′.

The stop arm 28 extends outwards in a substantially radial or spoke-like manner from the central journal pin 14*a* or the lower pin end 14*a*′ thereof, as can be seen from FIG. 3. On its radially outer end this stop arm 28 has a stop projection 28*b* which is directed axially upwards and can be fixed separately on this radially outer end, but is preferably constructed—as illustrated in the example according to FIG. 2—as an integral bent arm end.

FIGS. 2 and 3 also show that an outer circular groove 30 is machined into the underside of the housing 9 accommodating the cable pulley 5, i.e. in the outer peripheral region thereof (outside the cable pulley 5), and this groove extends approximately over the entire periphery of the housing 9 with the sole exception of the peripheral section in which the guide channel 13 is located for the introduction of the end 3*b* of the traction cable. The stop projection 28*b* of the stop arm 28 which points axially upwards is accommodated in the groove 30. The stop arm 28 is constructed and arranged in such a way that its stop projection 28*b* can slide along in the groove 30 during a corresponding rotary movement of the stop arm 28 about the central journal pin 14*a*/14*a*′. In this case the two peripheral ends 30*a* and 30*b* of this groove 30 form counter-stops for the stop projection 28*b*, i.e. the stop projection 28*b* comes to rest on these counter-stops 30*a*, 30*b* when the stop element 28 undergoes rotary movement in one or the other direction of rotation.

An entrainment stop 31 which is shaped rather like a small block and is firmly connected to the cable pulley 5 also projects downwards from the underside of the cable pulley 5 and, depending upon the rotated position and direction of rotation of the cable pulley 5 with reference to the peripheral direction, comes to rest on one or the other side 28*c* or 28*d* of the stop arm 28 and entrains this stop arm when the cable pulley 5 undergoes further rotary movement.

Figure 4:
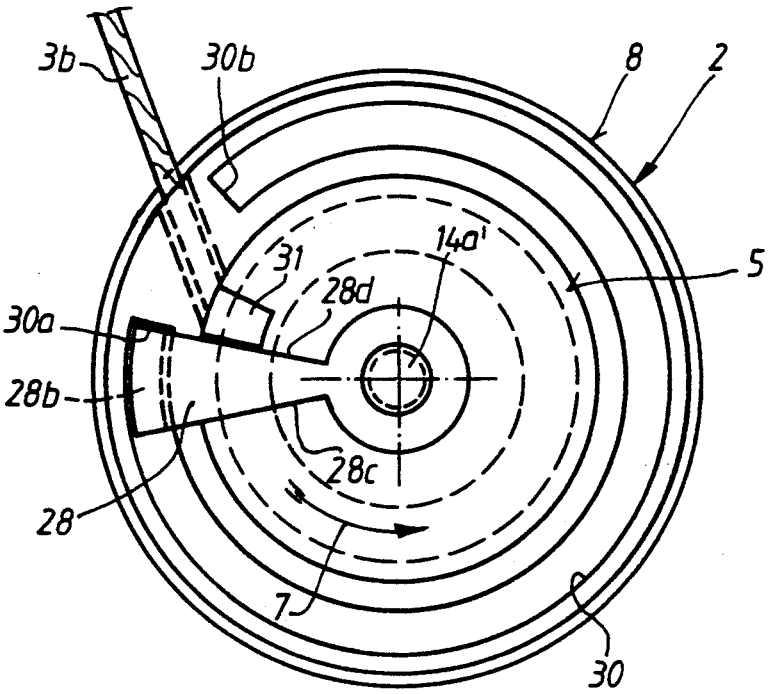
FIGS. 4 and 5 are underneath views similar to FIG. 3, illustrating other rotated positions of the cable pulley or of the stop element.
Figure 5:
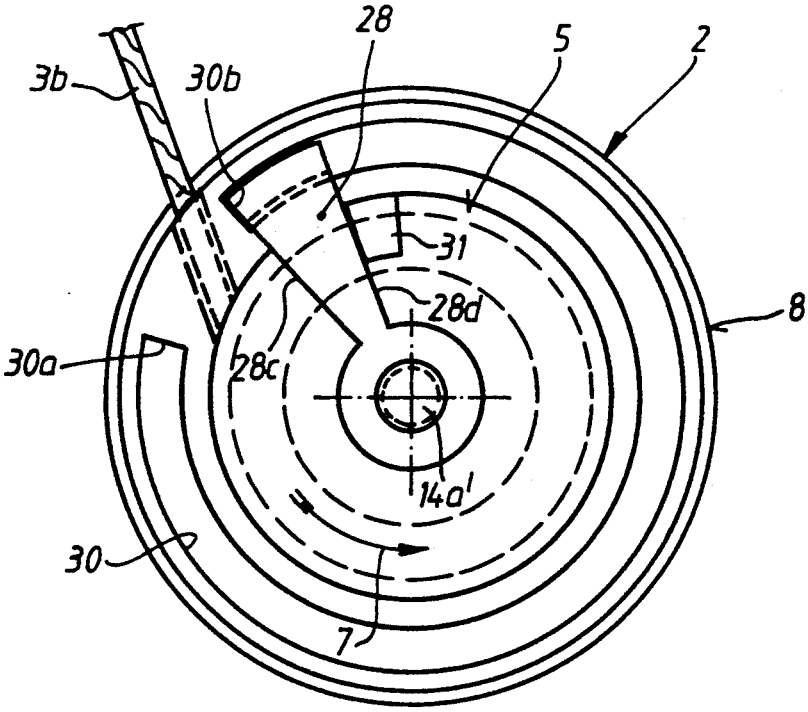

Various rotational or end positions of the stop arm 28 about the central journal pin 14*a* or 14*a'* are illustrated in FIGS. 3, 4 and 5.

In the rotational position according to FIG. 3 it may be assumed that the cable pulley 5 is located in its starting position in which the rotary closure 2 is fully released and the traction cable 3 is completely unwound from the cable pulley 5. In this basic rotational position the stop projection 28*b* lies with the side 28*d* of the stop arm 28 on the first counter-stop 30*a* of the groove 30. If the rotary knob 8 and thus the cable pulley 5 are rotated in the direction of the arrow 7 in order to wind the traction cable 3 with its end 3*b* on the cable pulley 5 to draw the closure flaps of the ski boot 1 together, then the cable pulley 5 is moved over almost one complete first rotation until its entrainment stop 31, which in the starting position had rested on the side 28*c* of the stop arm, comes to rest on the opposing side 28*d* of the stop arm, as FIG. 4 shows. Only when the cable pulley 5 is rotated further in the direction of the arrow 7 (i.e. in the same direction) out of the position according to FIG. 4 with the aid of the rotating knob 8 is the stop arm 28 entrained by the entrainment stop 31 in the same direction of rotation (arrow 7). This further rotary movement of the cable pulley 5 (in the rotational direction of the arrow 7) can then only be continued until the stop arm 28 or its stop projection 28*b* comes to rest with the side 28*c* on the second counter-stop 30*b* of the groove 30, as is shown in FIG. 5. This further rotary movement (after the first rotation) of the cable pulley 5 thus amounts to somewhat less than one full revolution due to the length of the groove 30 and the width of the stop arm 28.

From this comparison of the extreme rotational positions according to FIGS. 3 to 5 it can be seen that the cable pulley 5 can carry out almost two complete revolutions for winding the traction cable 3 on, so that a sufficiently long cable path is produced which makes it possible with one single traction cable 3 to ensure a sufficiently great movement of drawing together the two closure flaps of this ski boot 1 so that this ski boot can be reliably adapted to the foot of a ski boot user in the manner necessary in the particular case. The opening of the rotary closure 2, that is to say the unwinding of the traction cable 3 from the cable pulley 5 then takes place in exactly the opposite direction to that which was explained in connection with FIGS. 3 to 5. It should be emphasised in this connection that by the use of the ratchet mechanism any necessary intermediate position of the cable pulley 5 and thus of the rotary closure 2 can be set extremely sensitively and maintained.

A second embodiment of the rotary closure 2 according to the invention, with some further particularly advantageous constructions and further developments of the rotary closure parts are shown in FIGS. 6 to 9.

In these FIGS. 6 to 9 all rotary closure parts which are of the same or almost the same construction as those in the first embodiment are designated by the same reference numerals with the addition of a prime, so that a further detailed description of these closure parts is largely superfluous.

Reference is made first of all to FIGS. 6 and 7. It may be assumed here that—as is know per se—the end 3*b'* of the traction cable is fixed by means of an approximately pin-like nipple 32 on the cable pulley 5' or in the groove 11' thereof, i.e. this nipple 32 extends approximately parallel to the downwardly extending central journal pin 14'*a* of the sun gear 14'. As can be seen particularly well in the sectional detail according to FIG. 8, the traction cable nipple 32 has a projection 32*a* which projects downwards from the underside of the cable pulley 5' and is sufficiently long that in this embodiment it also simultaneously forms the entrainment stop which is firmly connected to the cable pulley 5' for the stop arm 28' which extends substantially radially outwards. Thus a separate entrainment stop, for instance like the block-shaped extension 31 of the first embodiment, is not necessary here.

However, it can be particularly advantageous if—as shown particularly in FIG. 8—the nipple projection 32*a* has a cap construction or a cap 33 in the illustrated form placed on its outer free end, i.e. this nipple 32 is thereby given an approximate mushroom shape.

In this case the stop arm 28' is advantageously constructed so that it does not extend in a completely straight line in the radial direction but rather it has on each of its opposing—viewed in the peripheral direction—sides 28'*c* and 28'*d* a recess 34 or 35 respectively which is adapted to the external diameter of the nipple 32 and serves for the nipple projection 32*a* to engage and fit. At least in the region of these recesses 34, 35 the material thickness of the stop arm 28' is reduced somewhat— as can be seen in FIGS. 7 and 8—so that there the cap 33 of the nipple projection 32*a* can partially be received under the stop arm 28' on engagement with the stop arm 28'. In this way any axial shifting of the stop arm 28' during the engagement between the nipple projection 32*a* and the respective recesses 34 or 35 is reliably prevented by the cap 33.

Whereas in the first embodiment (cf. in particular FIG. 2) the central section 28*a* of the stop arm 28 is secured on the outermost lower pin end 14*a'* with the aid preferably of a spring clip ring 29, in the example according to FIG. 6 a simplified fixing is proposed in which the central section 28'*a* of the stop arm 28' is fixed in the manner of a snap connection, this central section 28'*a* (with appropriately large opening) being snapped onto an annular groove 36 which is machined onto the outermost lower pin end 14*a'*.

Here too, in any case, the stop arm 28' again has on its radially outer end a stop projection 28'*b* which projects axially upwards and is slideably accommodated in the outer circular groove 30' which is machined into the underside of the housing 9' which accommodates the cable pulley 5'.

In the example according to FIGS. 6 and 7 at least two snap hooks 37 which are distributed over the periphery, i.e. according to FIG. 7 lie diametrically opposite one another, and are intended for fixing the entire rotary closure 2' on a sports shoe are constructed integrally on the lower outer peripheral edge of the housing 9'. For this purpose it is only necessary to provide in the upper material, for example in the shell of a ski boot or in the leather upper of another sports shoe, recesses into which the snap hooks 37 can be inserted so that they fit, so that a reliably firm and lasting snap connection is produced between the rotary closure 2' and the appertaining sports shoe, which means it can be put on extremely easily and quickly.

A rotary closure that is constructed according to the first example (FIGS. 1-5) or that is constructed according to the second example (FIGS. 6 to 9), can be made from any suitable material. This means that at least its essential closure parts can be made at least partially from metal, especially light metal, or from a suitable synthetic material which is capable of being cast and worked, particularly thermoplastic material. It can also optionally be advantageous to produce some of the essential closure parts from metal and some from synthetic material, so that the individual closure parts of a rotary closure can be produced from the materials which seem most advantageous in the particular case.

In the construction illustrated in FIG. 6 all essential parts of the rotary closure 2' may be made from synthetic material. The housing 9' and the housing cover 12' are included in the essential parts that may be made from synthetic material.

The housing cover 12' can be produced to a large extent with the same shape and construction as is described in detail with the aid of FIGS. 2 and 3 showing the first embodiment. As a first deviation therefrom, the housing cover 12' has on its underside and in the region of its outer peripheral edge at least two rivet constructions 38 which project towards the housing 9' which lies below and which are uniformly distributed over the periphery, i.e. in the case of two such rivet constructions 38 the latter lie diametrically opposite one another.

Two accurately fitting rivet receiving holes 39 are provided in the housing 9' so that they lie correspondingly opposite the two rivet constructions 38. The sizes of these rivet constructions 38 and rivet receiving holes 39 in the housing cover 12' and the housing 9' are coordinated with one another so that this housing 9' and the housing cover 12' can be quickly and reliably connected to one another by ultrasonic riveting during assembly of the whole rotary closure 2'.

In the embodiment shown in the cross-sectional view in FIG. 6, there are variants, from the embodiment shown in FIG. 2, not only of the housing cover 12' but also of the cap-shaped rotating knob 8'. The rotating knob 8' as shown in FIG. 6 is completely closed at the top and—as indicated by dash—dot lines—can have on its upper face a type of diagonally extending bar 40 for better actuation of the knob. The rotating knob 8' can also be provided only with an external milling in the same manner as in the first embodiment shown in FIG. 2.

In the embodiment shown in FIG. 6, it may be assumed that this cap-shaped rotating knob 8' is made in its entirety from a suitable synthetic material. On the inner face of the peripheral wall **8'*b* of the rotating knob 8', and offset inwards by a slight radial distance from this peripheral wall 8'*b*, there are either a number of individual snap connection elements uniformly distributed over the periphery or a type of integral casing-like snap connection element 41 constructed (formed integrally) so as to be sprung within the rotating knob 8'. The snap connection element 41 (or each individual snap connection element) has at its lower end (lower edge) a hook construction 41*a* which points radially inwards. Matching this hook construction 41*a*, an outer peripheral groove 42 is machined on the outer periphery of the housing cover 12'. The snap connection elements or the snap connection element 41 with the hook construction 41*a*, engages the groove 42 to provide simple assembly of the rotary closure 2'. The snap connection engagement between the hook construction 41*a* of the snap connection elements 41 and the outer peripheral groove 42 of the housing cover 12' is designed so that this outer peripheral groove 42 simultaneously forms a rotary guide groove for the snapped-in hook construction 41*a* and, thus for the entire appertaining rotating knob 8'. This construction results on the one hand in rotary guiding and on the other hand axial fixing of the rotary knob 8' with reference to the entire rotary closure 2'**.

The central sun gear 14' forms the drive gear set for the planetary gear which is arranged between the housing 9', the cable pulley 5' and the housing cover 12' and to which a stationary inner ring gear 17' and more planet wheels 18' also belong, in the same manner as in the first example. The sun gear 14' again has a substantially cylindrical journal pin end **14'*b* which extends axially upwards and extends upwards through a matching central bearing bore 16' in the housing cover 12' and a matching central bore 20'*a* in the intermediate disc 20' which lies above the housing cover 12'**.

Figure 9:
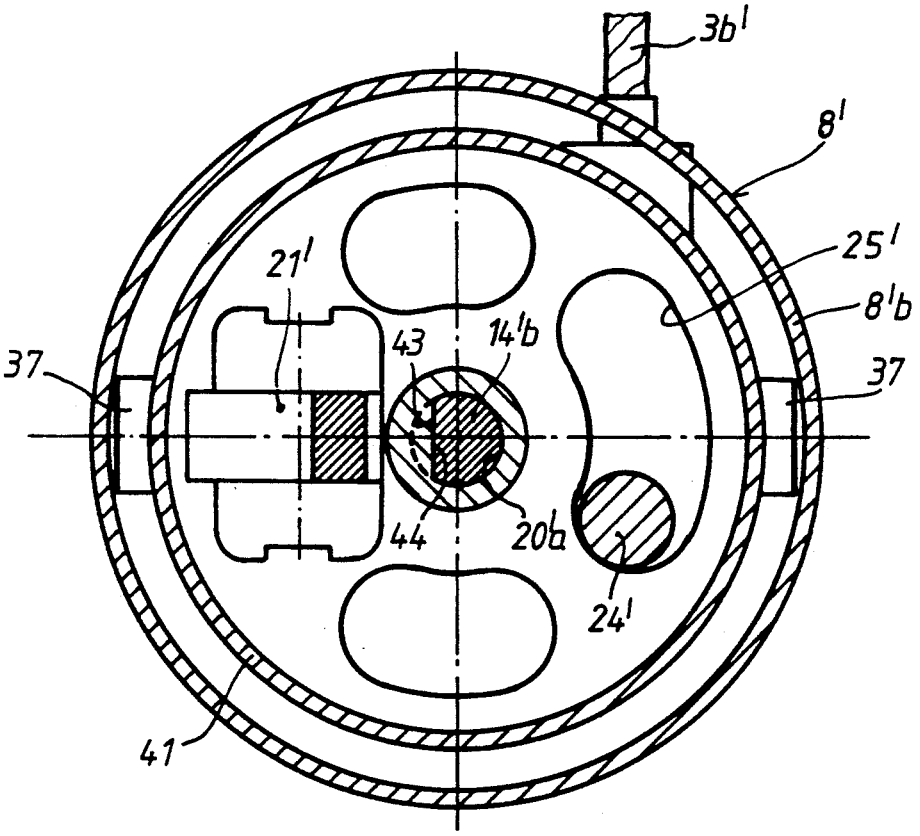
FIG. 9 is a horizontal sectional view along the line IX—IX in FIG. 6.

As can be seen from FIGS. 6 and 9, the journal pin end **14'*b* has on its end section, which passes axially through the intermediate disc 20', a peripheral flattening 43. The central bore 20'*a* in the intermediate disc 20' is constructed with a flattening corresponding to the end section of the journal pin end 14'*b* which is provided with the peripheral flattening 43, so that by means of the engagement of the journal pin end 14'*b* in the central bore 20'*a* of the intermediate disc 20' a connection which is fixed against rotation is produced between the journal pin end 14'*b* with the appertaining sun gear 14' and the intermediate disc 20'**.

The cap-shaped rotating knob 8' is positioned on the top of the rotary closure 2' as has already been clearly explained above. A connection which is fixed against rotation is produced between the journal pin end **14'*b* and the intermediate disc 20' in the same manner as in the first example or in the construction according to European patent application EP-A-255 869. A limited free play is maintained between the rotary knob 8' and the intermediate disc 20' in order to activate or release the ratchet mechanism which was explained above, with the ratchet 21 and the toothed ring 23 shown in FIG. 2. The connection between the rotary knob 8' and the cover 12' is fixed against axial movement. Free play between the rotating knob 8' and the intermediate disc 20' is allowed by a projection 24' which projects axially inwards from the inner face of the rotating knob 8' and engages in a recess 25' shaped like a ring segment, as can be seen clearly in FIGS. 6 and 9. In this case FIG. 6 also shows that the central upper end 20'*b* of the intermediate disc 20' can also at the same time ensure further guiding of the rotating knob 8', since on its inner face a ring-like projection 8'*c* projects axially downwards and correspondingly engages over the central upper end 20'*b* of the intermediate disc 20'. At the same time this ring-like projection 8'*c* can be constructed and come into engagement with the ratchet pawl 21' in such a way that it acts appropriately from above on this ratchet pawl 21' for the purpose of activating and releasing the ratchet pawl 21 from the toothed ring 23'**.

Even though in the introduction the use of the rotary closure according to the invention has been explained with the aid of FIG. 1 in relation to a ski boot 1, it should be emphasised that a rotary closure according to the above description can have an extremely suitable and practical application to other sports shoes, such as for example for marathon and other running shoes, tennis shoes and a large number of sports leisure shoes.

I claim:

1. A rotary closure for a sports shoe having closure flaps that may be drawn together to close a foot-accommodating opening and secure the shoe to a person's foot, said closure comprising a housing mounted on the shoe at one side of said opening; a cable pulley rotatably mounted in the housing; a cable having one end thereof attached to said pulley and its other end attached to said shoe on the opposite side of said opening; means for rotating said pulley in opposite directions to wind or unwind the cable on or from the pulley; stop means mounted in said housing for rotation relative to said housing and said pulley; entrainment stop means carried by said pulley for rotation therewith and occupying a position to engage and entrain said stop means in response to rotation of said pulley relative to said stop means and effect rotation of said stop means conjointly with said pulley in response to further rotation of said pulley following engagement of said stop means by said entrainment stop means; and limit means in the path of rotation of said stop means for limiting rotation thereof by said entrainment stop means.

2. The rotary closure according to claim 1 wherein the cable pulley is freely rotatable on a journal pin and the stop means is rotatably mounted on the housing for pivotal movement about the axis of the journal pin.

3. The rotary closure according to claim 2, wherein the stop means is pivotally connected to the journal pin.

4. The rotary closure according to claim 2 including an annular groove on a lower end of the journal pin and wherein the stop means is connected to the annular groove by a snap connection.

5. The rotary closure according to claim 2 wherein the entrainment stop is fixed on an under side of the cable pulley.

6. The rotary closure according to claim 2 wherein the cable is attached to the cable pulley by a nipple and the entrainment stop means comprises a projection on the lower end of the nipple.

7. The rotary closure according to claim 6 wherein the entrainment stop means partially engages an under side of the stop.

8. The rotary closure according to claim 7 wherein the stop includes two recesses operable to accommodate the entrainment stop means.

9. The rotary closure according to claim 1 wherein the housing has a circular groove having end walls constituting said limit means and wherein said stop means has a projection which extends into the circular groove for engagement with the respective ends of the circular groove.

10. A rotary closure for a sports shoe having closure flaps that may be drawn together to secure the shoe to a person's foot, said closure comprising a housing mounted on the shoe; a cable pulley mounted in said housing for rotation about an axis; a cable having one end thereto attached to the cable pulley and its other end fixed to the shoe; a journal pin having a central axis coincident with the axis of the pulley; a stop mounted beneath the cable pulley for pivotal movement about the central axis; end surfaces on the housing operable to limit pivotal movement of the stop about the central axis; an entrainment stop on the cable pulley engageable with the stop and operable to limit movement of the cable pulley about the central axis to about two revolutions; a planetary gear set connected between the central journal pin and the cable pulley; a rotary knob attached to the central journal pin for actuating the planetary gear set to drive the cable pulley in a direction to wind the cable on said cable pulley; and a ratchet mechanism operable to prevent the cable pulley from rotating in a direction to unwind the cable from said cable pulley when the ratchet mechanism is activated and which can be deactivated to allow the cable pulley to rotate and unwind the cable.

11. The rotary closure according to claim 10 wherein the planetary gear set includes a sun gear attached to the central journal pin, a ring gear on the housing, and at least one planet gear journaled on the cable pulley.

12. The rotary closure according to claim 10 wherein the ratchet mechanism includes an intermediate disc rotatable about the central axis, a ratchet pawl carried by the intermediate disc, a toothed ring attached to the housing and engageable with the ratchet pawl, and cam means to deactivate the ratchet pawl.

13. The rotary closure according to claim 12 wherein said cam means comprises a cam surface on the rotary knob and wherein limited movement of the rotary knob about the central axis relative to the intermediate disc moves the cam surface to deactivate the ratchet mechanism.

14. The rotary closure according to claim 10 wherein portions of the rotary closure are made of synthetic material.

15. The rotary closure according to claim 10 wherein snap hooks connected to the housing fix the rotary closure on said shoe.

* * * * *

UNITED STATES PATENT AND TRADEMARK OFFICE

CERTIFICATE OF CORRECTION

PATENT NO. : 5,152,038

DATED : October 6, 1992

INVENTOR(S) : Robert Schoch

It is certified that error appears in the above-identified patent and that said Letters Patent is hereby corrected as shown below:

Please substitute the following Abstract of the Disclosure for the Abstract originally filed:

-- ABSTRACT OF THE DISCLOSURE

A rotary closure for a sports shoe has a traction cable mechanism for drawing together the shoe closure flaps and can be wound onto and unwound from a rotatable cable pulley. The traction cable mechanism includes a single traction cable, and coaxially with the cable pulley a stop element rotatably mounted in such a way that the cable pulley can carry out a maximum of up to approximately two revolutions in one direction of rotation. In this way a particularly compact rotary closure is produced with reliable security against overrotation of the cable pulley.--

Column 3, line 15, after "planetary" insert -- gear --; line 57, after "ratchet" insert -- pawl --.

Column 4, line 34, after "extending" insert -- end --.

UNITED STATES PATENT AND TRADEMARK OFFICE

CERTIFICATE OF CORRECTION

PATENT NO. : 5,152,038

DATED : October 6, 1992

INVENTOR(S) : Robert Schoch

It is certified that error appears in the above-identified patent and that said Letters Patent is hereby corrected as shown below:

Column 8, line 40, cancel "the" (second occurrence).

Column 9, line 8, before "tennis" insert -- jogging shoes, --; line 50, after "stop" insert -- means --; line 52, after "stop" insert -- means --.

Signed and Sealed this

Second Day of November, 1993

*Attest:*

*Attesting Officer*

BRUCE LEHMAN

*Commissioner of Patents and Trademarks*